US005232807A

United States Patent [19]

Nakano et al.

[11] Patent Number: 5,232,807

[45] Date of Patent: Aug. 3, 1993

[54] ELECTROPHOTOGRAPHIC DEVELOPER

[75] Inventors: Tetsuya Nakano, Nabari; Naruo Yabe, Kobe; Masahide Inoue, Nara; Teruaki Teratani, Mino; Koichi Tsuyama, Kobe; Yoshitake Shimizu, Higashiosaka; Seijiro Ishimaru, Ibaraki, all of Japan

[73] Assignee: Mita Industrial Co., Ltd., Osaka, Japan

[21] Appl. No.: 735,270

[22] Filed: Jul. 24, 1991

[30] Foreign Application Priority Data

Jul. 26, 1990 [JP] Japan ..... 2-200296

[51] Int. Cl.[5] ..... G03G 9/113

[52] U.S. Cl. ..... 430/108; 430/109; 430/904

[58] Field of Search ..... 428/403, 407; 430/904, 430/108, 109

[56] References Cited

U.S. PATENT DOCUMENTS

| | | | |
|---|---|---|---|
| 4,042,517 | 8/1977 | Moriconi et al. | 252/62.1 P |
| 4,822,708 | 4/1989 | Machida et al. | 430/106.6 |
| 4,882,258 | 11/1989 | Ikeuchi et al. | 430/108 |
| 4,966,829 | 10/1990 | Yasuda et al. | 430/109 |
| 5,021,316 | 6/1991 | Kubo et al. | 430/108 |
| 5,071,725 | 12/1991 | Kubo et al. | 430/108 |

FOREIGN PATENT DOCUMENTS 0332212 10/1989 European Pat. Off. .

OTHER PUBLICATIONS

Patent Abstracts of Japan vol. 9, No. 190(P-378) Aug. 7, 1985 Konishiroku Shashin Kokyo K.K. (1) PN 60-59369, Apr. 1985.

*Primary Examiner*—Marion E. McCamish
*Assistant Examiner*—Rosemary Ashton
*Attorney, Agent, or Firm*—Beveridge, DeGrandi, Weilacher & Young

[57] ABSTRACT

The present invention provides an electrophotographic developer comprising (i) a toner containing, as a fixing resin, a styrene-acrylic copolymer presenting a gel permeation chromatogram showing a molecular-weight distribution in which the detection-starting molecular weight and the detection-ending molecular weight are respectively located in specific ranges, and (ii) a carrier coated with a coating resin which is a styrene-acrylic copolymer containing at least 2-hydroxyethyl acrylate.

Even though repeatedly agitated in the developing device, the electrophotographic developer of the present invention is not deteriorated and assures good durability and long life-time.

3 Claims, 1 Drawing Sheet

ELECTROPHOTOGRAPHIC DEVELOPER

BACKGROUND OF THE INVENTION

The present invention relates to an electrophotographic developer and more particularly to a two-component electrophotographic developer containing a toner and a carrier, to be used for an image forming apparatus such as an electrostatic copying apparatus, a laser beam printer or the like.

In the image forming apparatus above-mentioned, the surface of a photoreceptor is exposed to light to form an electrostatic latent image on the surface of the photoreceptor. By a developing device, an electrophotographic developer is let come in contact with the surface of the photoreceptor The toner contained in the electrophotographic developer is electrostatically sticked to the electrostatic latent image, so that the electrostatic latent image is formed into a toner image. From the photoreceptor surface, the toner image is transferred to and fixed on paper. Thus, an image corresponding to the electrostatic latent image is formed on the paper surface.

As the electrophotographic developer, there is generally used a two-component developer containing a toner and a carrier which is adapted to circulate in the developing device while adsorbing the toner.

As the toner, there may be used one as obtained by blending a fixing resin with a coloring agent such as carbon black, a charge controlling agent and the like and by pulverizing the blended body into particles having sizes in a predetermined range.

As the carrier, there may be preferably used a carrier having a core material made of iron particles or the like, of which surface is coated with a coating resin. The object of such coating of the carrier core material at the surface thereof with a coating resin is to control the toner electric charge amount and polarity, improve the dependency of the developer electric charge on humidity and prevent the occurrence of filming.

As the fixing resin and the coating resin, a styrene-acrylic copolymer may be suitably used in view of ease of handling and the like.

A conventional electrophotographic developer presents the following problems That is, when the developing operation is repeated, the developer is subjected to a mechanical pressure, an impact force, friction and the like in the developing device, causing the developer to be gradually deteriorated. This provokes the problems that the electric charging characteristics become unstable, the resultant image is deteriorated in quality and the toner consumption is increased.

As above-mentioned, when the developer is subjected to a mechanical pressure, an impact force, friction and the like in a developing device, the toner particles are crushed and the carrier coating resin falls or partially comes off from the carrier core material, thereby to produce defective fine particles. Such defective particles deteriorate the image in quality. More specifically, the defective particles agglomerate with the toner to form toner agglomerates having great particle sizes. Such toner agglomerates make the resultant image coarse to deteriorate the image quality. Further, the toner agglomerates as repeatedly agitated, are gradually grown to giant particles. When the toner image is transferred to paper, such giant particles are caught between the photoreceptor and the paper to form gaps therearound. This provokes a so-called blanking phenomenon that white portions are left on the image without the toner transferred to the paper. If a great amount of defective particles or toner agglomerates is formed, the toner consumption is accordingly increased and the toner density becomes unstable.

As mentioned earlier, the electric charging characteristics become unstable because the carrier coating resin falls down or partially comes off to injure the smoothness of the carrier surface, so that the carrier surface conditions undergo a change. More specifically, when the carrier surface is decreased in smoothness, this provokes a so-called spent toner that the toner as sticked to the carrier surface cannot come off therefrom. Further, the defective particles as interposed between the carrier and the toner accelerate the adhesion therebetween, provoking the increase in the amount of the spent toner. Such increase makes the developer electric charge uneven so that the developer is liable to be gradually lowered in electric charge. As a result, the electric charging characteristics become unstable. This provokes the problems that the image density becomes unstable and the toner is scattered to produce fog.

SUMMARY OF THE INVENTION

It is a main object of the present invention to provide a durable and long-life electrophotographic developer adapted not to be deteriorated even though repeatedly agitated in a developing device, thereby to produce no possibility of a variety of problems above-mentioned.

To achieve the object above-mentioned, the inventors of the present invention have studied hard the relationship between the physical properties of the carrier coating resin & the toner fixing resin, and the various problems above-mentioned, and found the following facts.

When the fixing resin comprising a styrene-acrylic copolymer contains a high-molecular-weight component of which molecular weight exceeds a certain level, and a low-molecular-weight component of which molecular weight is below a certain level, the toner particles produce a great amount of defective particles or toner agglomerates. More specifically, the high-molecular-weight component of which molecular weight exceeds a certain level, causes the fixing resin to be hard and fragil. Accordingly, the toner is liable to be crushed upon reception of external force during agitation. On the other hand, the low-molecular-weight component of which molecular weight is below a certain level, is highly viscous to bond the toner particles or defective particles to one another, causing toner agglomerates to grow.

It has also been found that the wear or partial coming-off of the coating resin resulted from the fact that the adhesion of a conventional coating resin to the carrier core material was insufficient and the strength of the coating film was insufficient. In this connection, the inventors have also studied the material of the coating resin and found that the coating resin could be improved in film strength and in adhesion with the carrier core material when there was used a styrene-acrylic copolymer containing at least 2-hydroxyethyl acrylate.

Based on the findings above-mentioned, the inventors have further studied and now completed the present invention.

The present invention provides an electrophotographic developer comprising (i) a toner containing, as a fixing resin, a styrene-acrylic copolymer presenting a gel permeation chromatogram showing a molecular-weight distribution in which the detection-starting molecular weight is located in a range from $1.6\times10^7$ to $2\times10^8$ and the detection-ending molecular weight is located in a range from 300 to 2,000, and (ii) a carrier coated with a coating resin which is a styrene-acrylic copolymer containing at least 2-hydroxyethyl acrylate.

DETAILED DESCRIPTION OF THE INVENTION

Figure 1:
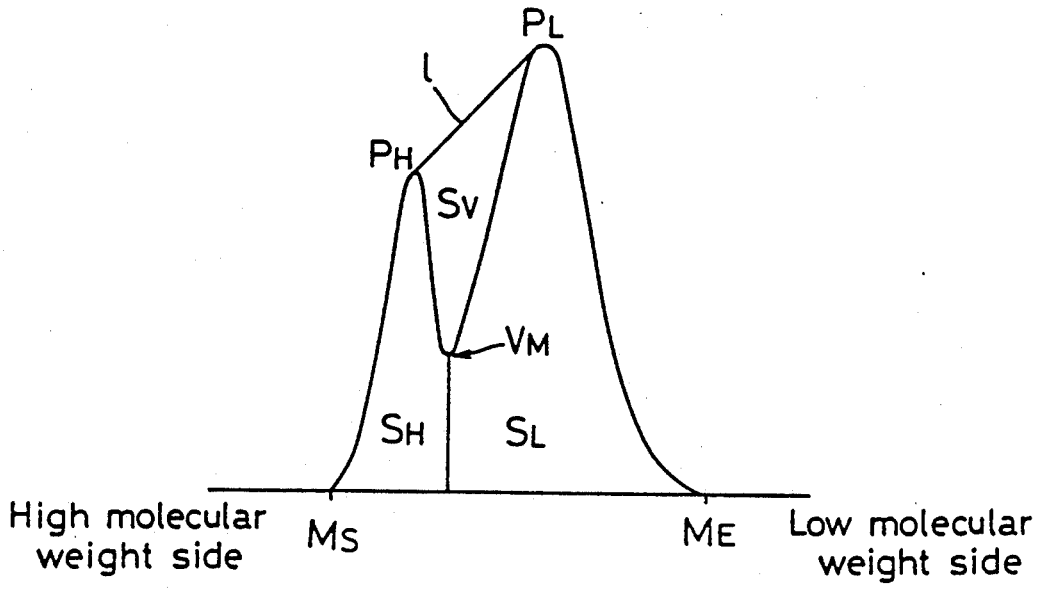
FIG. 1 is a gel permeation chromatogram showing the molecular-weight distribution of a styrene-acrylic copolymer.

As the styrene-acrylic copolymer serving as a toner fixing resin, there is used one presenting a gel permeation chromatogram shown in FIG. 1 in which the detection-starting molecular weight $M_S$ is located in a range from $1.6\times10^7$ to $2\times10^8$ and the detection-ending molecular weight $M_E$ is located in a range from 300 to 2000.

The detection-starting molecular weight $M_S$ is limited to the range from $1.6\times10^7$ to $2\times10^8$ for the reason set forth below. If the detection-starting molecular weight $M_S$ exceeds $2\times10^8$ and the fixing resin contains a high-molecular-weight component of which molecular weight exceeds $2\times10^8$, the fixing resin becomes hard and fragil so that the toner is liable to be crushed upon reception of external force when agitated. On the other hand, if the detection-starting molecular weight $M_S$ is less than $1.6\times10^7$ and the fixing resin does not contain a component of which molecular weight is in a range from $1.6\times10^7$ to $2\times10^8$, the fixing properties of the toner to paper are lowered. This readily produces a so-called off-set such as contamination of paper at the reverse side thereof by toner particles coming off therefrom, contamination of the fixing rollers and the like.

The detection-ending molecular weight $M_E$ is limited to the range from 300 to 2,000 for the reason set forth below. If the detection-ending molecular weight $M_E$ is less than 300 and the fixing resin contains a low-molecular-weight component of which molecular weight is less than 300, the fixing resin becomes highly viscous so that the toner is liable to produce agglomerates. On the other hand, if the detection-ending molecular weight $M_E$ exceeds 2,000 and the fixing resin does not contain a component of which molecular weight is in the range from 300 to 2,000, the fixing properties of the toner to paper are deteriorated.

In view of the foregoing, the electrophotographic developer of the present invention is arranged such that the styrene-acrylic copolymer serving as the toner fixing resin presents a gel permeation chromatogram in which the detection-starting molecular weight $M_S$ is limited to the range from $1.6\times10^7$ to $2\times10^8$ and the detection-ending molecular weight $M_E$ is limited to the range from 300 to 2,000.

In the molecular-weight distribution of the styrene-acrylic copolymer above-mentioned, no particular restrictions are imposed on other data than the detection-starting molecular weight $M_S$ and the detectionending molecular weight $M_E$. However, to prevent the off-set above-mentioned and enhance the fixing properties of the toner to paper, it is preferable to jointly use a high-molecular-weight component excellent in off-set prevention and a low-molecular-weight component excellent in fixing properties. Accordingly, there is preferably used a styrene-acrylic copolymer presenting a molecular-weight distribution shown in FIG. 1 in which the maximum values $P_H$ and $P_L$ are respectively. located in the high molecular-weight side and the low molecular-weight side between the detection-starting molecular weight $M_S$ and the detectionending molecular weight $M_E$ and in which the minimum value $V_M$ is located between both maximum values $P_H$ and $P_L$.

The molecular weight at the maximum value $P_H$ at the high-molecular-weight side is preferably not less than $1\times10^5$. If the molecular weight at the maximum value $P_H$ is less than $1\times10^5$, the amount of the high-molecular-weight component in the styrene-acrylic copolymer is insufficient. This involves the likelihood that a toner excellent in resistance to off-set cannot be obtained.

The molecular weight at the maximum value $P_L$ at the low-molecular-weight component is preferably in a range from 500 to $2\times10^4$. If the molecular weight at the maximum value $P_L$ exceeds $2\times10^4$, the amount of the low-molecular-weight component in the styrene-acrylic copolymer is insufficient. This involves the likelihood that a toner excellent in fixing properties at a low temperature cannot be obtained. On the other hand, if the molecular weight at the maximum value $P_L$ is less than 500, the shape retention of the styrene-acrylic copolymer is insufficient. This involves the likelihood that a toner excellent in durability cannot be obtained.

The molecular weight at the minimum value $V_M$ in the molecular-weight distribution may be located between both maximum values $P_H$ and $P_L$.

A ratio (V/P) is introduced from the following equation:

$$V/P = \frac{S_V}{S_H + S_L}$$

where $S_H$: Area of the peak part containing the maximum value $P_H$, $S_L$: Area of the peak part containing the maximum value $P_L$, and $S_V$: Area of the valley part containing the minimum value $V_M$ and located below a common tangential line l which connects both peaks.

The ratio (V/P) represents how the curve of molecular-weight distribution of the styrene-acrylic copolymer is approximated to a quadrilateral formed by connecting both maximum values with the common tangential line l. As the ratio (V/P) is smaller, the curve is more approximated to the quadrilateral. This serves as an index which shows the amount of the intermediate molecular-weight component which lies between high and low molecular-weight components. More specifically, as the ratio (V/P) is smaller, the amount of the intermediate molecular-weight component is greater. This makes it possible to produce a toner having the optimum combination of fixing properties, resistance to off-set and durability.

According to the present invention, the ratio (V/P) is preferably not greater than 0.30, and more preferably not greater than 0.20. When the (V/P) exceeds 0.30, the amount of the intermediate molecularweight component contained in the styrene-acrylic copolymer is insufficient. This may deteriorate the uniformity and durability of the toner, and may not restrain defective fixing and off-set.

No particular restrictions are imposed on the ratio of the area $S_H$ of the peak part containing the maximum value $P_H$ at the high molecular-weight component side to the area $S_L$ of the peak part containing the maximum value $P_L$ at the low molecular-weight component side. However, such a ratio ($S_H$:$S_L$) is preferably in a range from 15:85 to 50:50, and more preferably from 20:80 to 45:55.

To produce the styrene-acrylic copolymer having the molecular-weight distribution above-mentioned, there are available three methods, i.e., a method of increasing the variance of the low molecular-weight component (molecular-weight distribution of $M_W/M_N$, in which $M_W$ is a weight-average molecular weight and $M_N$ is a number-average molecular weight), a method of increasing the variance of the high molecular-weight component ($M_W/M_N$), and a method of increasing the variance of the high and low molecular-weight components ($M_W/M_N$). In short, it is enough to increase the overlap of both high and low molecular-weight distributions. Generally, it is preferable to increase the variance of the high molecular-weight component ($M_W/M_N$) in view of various characteristics of toner. The variance of the high molecular-weight component ($M_W/M_N$) is preferably in a range from 2.7 to 3.7, and more preferably from 3.0 to 3.4. The variance of the low molecular-weight component ($M_W/M_N$) is preferably in a range from 1.5 to 2.5 and more preferably from 1.8 to 2.2.

The styrene-acrylic copolymer may be produced either by tightly melting and blending a plurality of types of styrene-acrylic copolymers having different molecular-weight distributions, or by using a twostage polymerization, such that the resultant styrene-acrylic copolymer have the molecular-weight distribution above-mentioned.

Figure 2:
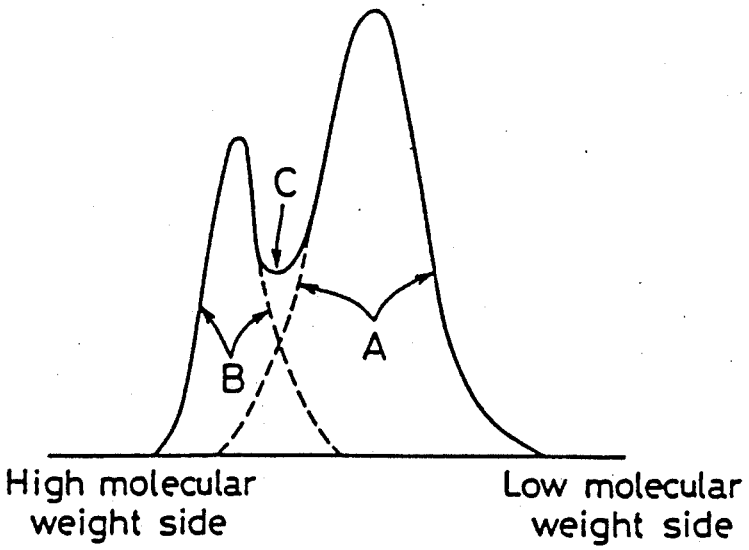
FIG. 2 is a gel permeation chromatogram illustrating an example of a method of obtaining a styrene-acrylic copolymer having the molecular-weight distribution shown in FIG. 1.

For example, as shown in FIG. 2, when there are molten and blended, in the same amount, a styrene-acrylic copolymer (low molecular-weight component) having a molecular-weight distribution shown by a curve A and a styrene-acrylic copolymer (high molecular-weight component) having a molecular-weight distribution shown by a curve B, there is obtained a styrene-acrylic copolymer having a molecular-weight distribution, as shown by a curve C, which is located in the range determined according to the present invention.

According to a suspension polymerization or an emulsion polymerization, a polymer having a high molecular weight may be generally more easily produced as compared with a solution polymerization. Accordingly, the styrene-acrylic copolymer having the molecularweight distribution above-mentioned may be produced by a multi-stage polymerization in which the suspension polymerization or the emulsion polymerization and the solution polymerization are combined in this order or in the reverse order with the molecular weight adjusted at each stage. The molecular weight or molecular-weight distribution may be adjusted by suitably selecting the type or amount of an initiator, the type of a solvent, a dispersing agent or an emulsifying agent relating to chain transfer, and the like.

As a styrene monomer, there may be used vinyltoluene, α-methylstyrene or the like, besides styrene. As an acrylic monomer, there may be used a monomer represented by the following general formula (I):

$$CH_2{=}\overset{\overset{R^1}{|}}{C}{-}CO{-}O{-}R^2 \qquad (I)$$

wherein $R^1$ is a hydrogen atom or a lower alkyl group, $R^2$ is a hydrogen atom, a hydrocarbon group having 1 to 12 carbon atoms, a hydroxyalkyl group, a vinylester group or an aminoalkyl group.

Examples of the acrylic monomer represented by the general formula (I), include acrylic acid, methacrylic acid, methyl acrylate, ethyl acrylate, butyl acrylate, 2-ethylhexyl acrylate, cyclohexyl acrylate, phenyl acrylate, methyl methacrylate, hexyl methacrylate, 2-ethylhxyl methacrylate, ethyl β-hydroxyacrylate, propyl γ-hydroxyacrylate, butyl δ-hydroxyacrylate, ethyl β-hydroxymethacrylate, propyl γ-aminoacrylate, propyl γ-N,N-diethylaminoacrylate, ethylene glycol dimethacrylate, tetraethylene glycol dimethacrylate and the like.

A styrene/methyl methacrylate/butyl acrylate copolymer may be used as the most suitable styrene-acrylic copolymer. There may be preferably used a styrene/methyl methacrylate/butyl acrylate copolymer containing 75 to 85% by weight of styrene, 0.5 to 5% by weight of methyl methacrylate and 10 to 20% by weight of butyl acrylate.

The toner may be produced by blending the fixing resin above-mentioned with additives such as a coloring agent, a charge controlling agent, a release agent (offset preventing agent) and the like, and by pulverizing the blended body into particles having suitable particle sizes.

Examples of the coloring agent include a variety of a coloring pigment, an extender pigment, a conductive pigment, a magnetic pigment, a photoconductive pigment and the like. The coloring agent may be used alone or in combination of plural types according to the application.

The following examples of the coloring pigment may be suitably used.

Black

Carbon black such as furnace black, channel black, thermal, gas black, oil black, acetylene black and the like, Lamp black, Aniline black White Zinc white, Titanium oxide, Antimony white, Zinc sulfide Red Red iron oxide, Cadmium red, Red lead, Mercury cadmium sulfide, Permanent red 4R, Lithol red, Pyrazolone red, Watching red calcium salt, Lake red D, Brilliant carmine 6B, Eosine lake, Rhodamine lake B, Alizarine lake, Brilliant carmine 3B Orange Chrome orange, Molybdenum orange, Permanent orange GTR, Pyrazolone orange, Vulcan orange, Indanthrene brilliant orange RK, Benzidine orange G, Indanthrene brilliant orange GK Yellow Chrome yellow, Zinc yellow, Cadmium yellow, Yellow iron oxide, Mineral fast yellow, Nickel titanium yellow, Naples yellow, Naphthol yellow S, Hansa yellow G, Hansa yellow 10G, Benzidine yellow G, Benzidine yellow GR, Quinoline yellow lake, Permanent yellow NCG, Tartrazine lake Green Chrome green, Chromium oxide, Pigment green B, Malachite green lake, Fanal yellow green G Blue Prussian blue, Cobalt blue, Alkali blue lake, Victoria blue lake, Partially chlorinated phthalocyanine blue, Fast sky blue, Indanthrene blue BC Violet Manganese violet, Fast violet B, Methyl violet lake Examples of the extender pigment include Baryte powder, barium carbonate, clay, silica, white carbon, talc, alumina white.

Examples of the conductive pigment include conductive carbon black, aluminium powder and the like.

Examples of the magnetic pigment include a variety of ferrites such as triiron tetroxide ($Fe_3O_4$), iron sesquioxide ($\gamma$-$Fe_2O_3$), zinc iron oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_4$), copper iron oxide ($CuFe_2O_4$), lead iron oxide ($PbFe_{12}O_{19}$), neodymium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder, cobalt powder, nickel powder and the like.

Examples of the photoconductive pigment include zinc oxide, selenium, cadmium sulfide, cadmium selenide and the like.

The coloring agent may be contained in an amount from 1 to 30 parts by weight and preferably from 2 to parts by weight for 100 parts by weight of the fixing resin.

As the electric charge controlling agent, there may be used either one of two different electric charge controlling agents of the positive charge controlling type and the negative charge controlling type, according to the toner polarity.

As the electric charge controlling agent of the positive charge controlling type, there may be used an organic compound having a basic nitrogen atom such as a basic dye, aminopyrine, a pyrimidine compound, a polynuclear polyamino compound, aminosilane, a filler of which surface is treated with any of the substances above-mentioned.

As the electric charge controlling agent of the negative charge controlling type, there may be used a compound containing a carboxy group (such as metallic chelate alkyl salicylate or the like), a metal complex salt dye, fatty acid soap, metal salt naphthenate or the like.

The electric charge controlling agent may be used in an amount from 0.1 to 10 parts by weight and more preferably from 0.5 to 8 parts by weight for 100 parts by weight of the fixing resin.

Examples of the release agent (off-set preventing agent) include aliphatic hydrocarbon, aliphatic metal salts, higher fatty acids, fatty esters, its partially saponified substances, silicone oil, waxes and the like. Of these, there is preferably used aliphatic hydrocarbon of which weight-average molecular weight is from 1,000 to 10,000. More specifically, there is suitably used one or a combination of plural types of low-molecular-weight polypropylene, low-molecular-weight polyethylene, paraffin wax, a low-molecular-weight olefin polymer composed of an olefin monomer having 4 or more carbon atoms and the like.

The release agent may be used in an amount from 0.1 to 10 parts by weight and preferably from 0.5 to 8 parts by weight for 100 parts by weight of the fixing resin.

The toner is produced by a method of previously mixing the components above-mentioned uniformly with the use of a dry blender, a Henschel mixer, a ball mill or the like, uniformly melting and kneading the resultant mixture with the use of a kneading device such as a Banbury mixer, a roll, a single- or doubleshaft extruding kneader or the like, cooling and grinding the resultant kneaded body, and classifying the resultant ground pieces as necessary. The toner may also be produced by suspension polymerization or the like.

The toner particle size is preferably from 3 to 35 $\mu$m and more preferably from 5 to 25 $\mu$m.

To improve the flowability, the toner surface may be covered with a conventional surface treating agent such as inorganic fine particles (such as hydrophobic silica fine particles), fluoroplastic particles or the like.

As the carrier forming, together with the toner above-mentioned, the electrophotographic developer in accordance with the present invention, there may be used a carrier having a core material made of any of conventional materials, of which surface is coated with a coating resin which is a styrene-acrylic copolymer containing at least 2-hydroxyethyl acrylate.

As the styrene-acrylic copolymer containing at least 2-hydroxyethyl acrylate, there may be used a styrene-acrylic copolymer in which the acrylic component is entirely composed of 2-hydroxyethyl acrylate, but generally used a copolymer formed with a styrene monomer & an acrylic monomer (of which examples have been mentioned earlier), and the 2-hydroxyethyl acrylate above-mentioned. No particular restrictions are imposed on the concentration of 2-hydroxyethyl acrylate contained in the styrene-acrylic copolymer. However, the concentration of 2-hydroxyethyl acrylate is preferably not greater than 2% by weight and more preferably in a range from 0.1 to 2% by weight.

The copolymer above-mentioned may be produced from the monomers by a conventional polymerization such as a solution polymerization or the like.

The coating resin may contain about 0.5 to about 5% by weight of carbon black serving as a resistance adjusting agent and about 0.5 to about 3% by weight of a metal complex or the like serving as an electric charge controlling agent.

Examples of the carrier core material include (i) particles of iron, oxidized iron, reduced iron, magnetite, copper, silicon steel, ferrite, nickel, cobalt and the like, (ii) particles of alloys of any of the metals above-mentioned with manganese, zinc, aluminium and the like, (iii) particles of an ironnickel alloy, an iron-cobalt alloy and the like, (iv) particles obtainable by dispersing any of the particles above-mentioned in a binder resin, (v) particles of ceramics such as titanium oxide, aluminium oxide, copper oxide, magnesium oxide, lead oxide, zirconium oxide, silicon carbide, magnesium titanate, barium titanate, lithium titanate, lead titanate, lead zirconate, lithium niobate and the like, and (vi) particles of high-permittivity substances such as ammonium dihydrogen phosphate ($NH_4H_2PO_4$), potassium dihydrogen phosphate ($KH_2PO_4$), Rochelle salt and the like. Of these, iron powder of iron oxide, reduced iron and the like, and ferrite are preferable in view of low cost and excellent image characteristics.

Any of conventional coating methods such as a fluidized bed method, a rolling bed method and the like may be used for coating the carrier core material at the surface thereof with the coating resin comprising the styrene-acrylic copolymer above-mentioned.

The particle sizes of the carrier core material are preferably from 30 to 200 μm and more preferably from 50 to 130 μm. The coating thickness is preferably from 0.1 to 5 μm and more preferably from 0.5 to 3 μm.

The blending ratio of the carrier and the toner may be suitably changed according to the type of an image forming apparatus to be used.

The electrophotographic developer in accordance with the present invention has the arrangement above-mentioned and comprises (i) a toner formed with the use of a fixing resin containing neither such a highmolecular-weight component as to cause the fixing resin to become hard and fragile, nor such a low-molecular-weight component as to produce toner agglomerates, and (ii) a carrier coated with a material excellent in film strength and adhesion with the carrier core material. Thus, the electrophotographic developer of the present invention is capable of overcoming various problems resulting from the crushing or agglomeration of toner particles, the wear or coming-off of the carrier coating resin and the like. Accordingly, even though repeatedly agitated in the developing device, the electrophotographic developer of the present invention is not deteriorated to assure good durability and long life-time.

EXAMPLES

The following description will further discuss the present invention with reference to Examples thereof and Comparative Examples.

EXAMPLES 1 TO 3, COMPARATIVE EXAMPLES 1 TO 7

The following toners and carriers were combined with each other in the manners shown in Table 1 at a ratio by weight of 4:96, and agitated and mixed with a Nauter mixer (NX-S manufactured by Hosokawa Micron Co., Ltd.) to produce developers of Examples 1 to 3 and Comparative Examples 1 to 7.

Toner (1)

There were mixed (i) 100 parts by weight of a styrene (St)/methyl methacrylate (MMA)/butyl acrylate (BA) copolymer [St:MMA:BA=80:5:15 (ratio by weight)] having the following molecular-weight distribution, (ii) 10 parts by weight of carbon black as the coloring agent, (iii) 3 parts by weight of a negative-polarity dye as the charge controlling agent, and (iv) 1 part by weight of low molecular-weight polypropylene as an off-set preventing agent. After molten and kneaded, the resulting mixture was cooled, ground and classified to produce a toner (1) having the average particle size of 10 μm.

Molecular-Weight Distribution

1) Detection-starting molecular weight $M_S$:$1\times10^8$
2) Detection-ending molecular weight $M_E$:521
3) Molecular weight of the maximum value $P_H$:435000
4) Variance of the peak containing the maximum value $P_H(M_W/M_N)$:2.32
5) Area of the peak containing the maximum value $P_H$ ($S_H$):25
6) Molecular weight of the maximum value $P_L$:13300
7) Variance of the peak containing the maximum value $P_L$ ($M_W M_N$):2.11
8) Area of the peak containing the maximum value $P_L$ ($S_L$):75
9) Molecular weight of the minimum value $V_M$:72000
10) Area of the valley containing the minimum value $V_M$ ($S_V$) 19
11) Ratio (V/P):0.19

Toner (2)

There was prepared a toner (2) in the same manner as in Toner (1) except for the use of 100 parts by weight of a styrene (St)/methyl methacrylate (MMA)/butyl acrylate (BA) copolymer [St:MMA:BA=80:10:10 (ratio by weight)] having the following molecular-weight distribution, instead of 100 parts by weight of the copolymer used in Toner (1).

Molecular-Weight Distribution

1) Detection-starting molecular weight $M_S$: $3.6\times10^7$
2) Detection-ending molecular weight $M_E$:390
3) Molecular weight of the maximum value $P_H$:335000
4) Variance of the peak containing the maximum value $P_H$ ($M_W/M_N$):1.53
5) Area of the peak containing the maximum value $P_H$ ($S_H$):22
6) Molecular weight of the maximum value $P_L$:13900
7) Variance of the peak containing the maximum value $P_L$ ($M_W/M_N$):2.30
8) Area of the peak containing the maximum value $P_L$ ($S_L$):78
9) Molecular weight of the minimum value $V_M$:76000
10) Area of the valley containing the minimum value $V_M$ ($S_V$):20
11) Ratio (V/P):0.20

Toner (3)

There was prepared a toner (3) in the same manner as in Toner (1) except for the use of 100 parts by weight of a styrene (St)/methyl methacrylate (MMA)/butyl acrylate (BA) copolymer [St:MMA:BA=80:8:12 (ratio by weight)] having the following molecular-weight distribution, instead of 100 parts by weight of the copolymer used in Toner (1).

Molecular-Weight Distribution

1) Detection-starting molecular weight $M_S$:$3.2\times10^8$
2) Detection-ending molecular weight $M_E$:382
3) Molecular weight of the maximum value $P_H$:290100
4) Variance of the peak containing the maximum value $P_H$ ($M_W/M_N$):1.83
5) Area of the peak containing the maximum value $P_H$ ($S_H$):23
6) Molecular weight of the maximum value $P_L$:13100
7) Variance of the peak containing the maximum value $P_L$ ($M_W/M_N$):2.04
8) Area of the peak containing the maximum value $P_L$ ($S_L$):77
9) Molecular weight of the minimum value $V_M$:69000
10) Area of the valley containing the minimum value $V_M$ ($S_V$):20
11) Ratio (V/P):0.20

Toner (4)

There was prepared a toner (4) in the same manner as in Toner (1) except for the use of 100 parts by weight of a styrene (St)/methyl methacrylate (MMA)/butyl acrylate (BA) copolymer [St:MMA:BA=85:10:5 (ratio by weight)] having the following molecular-weight distribution, instead of 100 parts by weight of the copolymer used in Toner (1).

Molecular-Weight Distribution

1) Detection-starting molecular weight $M_S$:$2.9\times10^7$
2) Detection-ending molecular weight $M_E$:285
3) Molecular weight of the maximum value $P_H$:435000
4) Variance of the peak containing the maximum value $P_H$ ($M_W/M_N$):2.29
5) Area of the peak containing the maximum value $P_H$ ($S_H$):25
6) Molecular weight of the maximum value $P_L$:13100
7) Variance of the peak containing the maximum value $P_L$ ($M_W/M_N$):2.32
8) Area of the peak containing the maximum value $P_L$ ($S_L$):75
9) Molecular weight of the minimum value $V_M$:77000
10) Area of the valley containing the minimum value $V_M$ ($S_V$):19
11) Ratio (V/P):0.19

Toner (5)

There was prepared a toner (5) in the same manner as in Toner (1) except for the use of 100 parts by weight of a styrene (St)/methyl methacrylate (MMA)/butyl acrylate (BA) copolymer [St:MMA:BA=82:5:13 (ratio by weight)] having the following molecular-weight distribution, instead of 100 parts by weight of the copolymer used in Toner (1).

Molecular-Weight Distribution

1) Detection-starting molecular weight $M_S$:$1.8\times10^7$
2) Detection-ending molecular weight $M_E$:312
3) Molecular weight of the maximum value $P_H$:350000
4) Variance of the peak containing the maximum value $P_H$ ($M_W/M_N$):1.95
5) Area of the peak containing the maximum value $P_H$ ($S_H$):24
6) Molecular weight of the maximum value $P_L$:12000
7) Variance of the peak containing the maximum value $P_L$ ($M_W/M_N$):2.23
8) Area of the peak containing the maximum value $p_L$ ($S_L$):76
9) Molecular weight of the minimum value $V_M$:70000
10) Area of the valley containing the minimum value $V_M$ ($S_V$):19
11) Ratio (V/P):0.19

Toner (6)

There was prepared a toner (6) in the same manner as in Toner (1) except for the use of 100 parts by weight of a styrene (St)/methyl methacrylate (MMA)/butyl acrylate (BA) copolymer [St:MMA:BA 85:10:5 (ratio by weight)] having the following molecular-weight distribution, instead of 100 parts by weight of the copolymer used in Toner (1).

Molecular-Weight Distribution

1) Detection-starting molecular weight $M_S$:$1.5\times10^7$
2) Detection-ending molecular weight $M_E$:390
3) Molecular weight of the maximum value $P_H$:290000
4) Variance of the peak containing the maximum value $P_H$ ($M_W/M_N$):2.01
5) Area of the peak containing the maximum value $P_H$ ($S_H$):20
6) Molecular weight of the maximum value $P_L$:12500
7) Variance of the peak containing the maximum value $P_L$ ($M_W/M_N$):2.21
8) Area of the peak containing the maximum value $P_L$ ($S_L$):80
9) Molecular weight of the minimum value $V_M$:65000
10) Area of the valley containing the minimum value $V_M$ ($S_V$):28
11) Ratio (V/P):0.28

Toner (7)

There was prepared a toner (7) in the same manner as in Toner (1) except for the use of 100 parts by weight of a styrene (St)/methyl methacrylate (MMA)/butyl acrylate (BA) copolymer [St:MMA:BA=80:5:15 (ratio by weight)] having the following molecular-weight distribution, instead of 100 parts by weight of the copolymer used in Toner (1).

Molecular-Weight Distribution

1) Detection-starting molecular weight $M_S$:$1.2\times10^8$
2) Detection-ending molecular weight $M_E$:2200
3) Molecular weight of the maximum value $P_H$:400000
4) Variance of the peak containing the maximum value $P_H$ ($M_W/M_N$):2.21
5) Area of the peak containing the maximum value $P_H$ ($S_H$):23
6) Molecular weight of the maximum value $P_L$:25000
7) Variance of the peak containing the maximum value $P_L$ ($M_W/M_N$):2.02
8) Area of the peak containing the maximum value $P_L$ ($S_L$):77
9) Molecular weight of the minimum value $V_M$:78000
10) Area of the valley containing the minimum value $V_M$ ($S_V$):26
11) Ratio (V/P):0.26

Carrier (a)

By a fluidized bed method, ferrite as the carrier core material was coated at the surface thereof with a solution containing (i) 100 parts by weight of a styrene (St)/ethyl methacrylate (EMA)/2-hydroxyethyl acrylate(HEA) copolymer [St:EMA:HEA=18:80:2 (ratio by weight)] as the coating resin and (ii) 2 parts by weight of carbon black as the resistance adjusting agent, thereby to prepare a carrier (a) having the average particle size of 95 μm of which coating layer had a thickness of 2 μm.

Carrier (b)

There was prepared a carrier (b) in the same manner as in the carrier (a) except for the use of 100 parts by weight of a styrene (St)/ethyl methacrylate (EMA)/2-hydroxyethyl acrylate(HEA)/dodecyl methacrylate (DMA) copolymer [St:EMA:HEA:DMA=20:76:2:2 (ratio by weight)] instead of 100 parts by weight of the coating resin used in the carrier (a).

Carrier (c)

There was prepared a carrier (c) in the same manner as in the carrier (a) except for the use of 100 parts by weight of a styrene (St)/ethyl methacrylate copolymer [St:EMA=20:80 (ratio by weight)] instead of 100 parts by weight of the coating resin used in the carrier (a).

TABLE 1

| | Toner | Carrier |
|---|---|---|
| Example 1 | (1) | (a) |
| Example 2 | (2) | (b) |
| Example 3 | (5) | (a) |
| Comparative Example 1 | (7) | (b) |
| Comparative Example 2 | (3) | (a) |
| Comparative Example 3 | (3) | (c) |
| Comparative Example 4 | (2) | (c) |
| Comparative Example 5 | (4) | (a) |
| Comparative Example 6 | (6) | (c) |
| Comparative Example 7 | (4) | (c) |

The following tests were conducted on each of the electrophotographic developers of Examples 1 to 3 and Comparative Examples 1 to 7.

Test of Fixing Temperature

While the temperature set to the heating rollers of an electrophotographic copying apparatus (Modified Type of DC-5585 manufactured by Mita Industrial Co., Ltd.) was raised in steps of 2.5° C. from 140° C., paper having thereon a toner image corresponding to a solid-black document was passed in the apparatus, causing the image to be fixed. An adhesive tape was pressingly contacted with each fixed image and then separated. The density data of each fixed image before and after separation, were measured with a reflection densitometer (TC-6D manufactured by Tokyo Densyoku Co., Ltd.). According to the following equation, there was obtained the lowest temperature at which the fixing ratio exceeded 90%, and the temperature at which offset occurred. There was calculated the difference between both temperatures above-mentioned as a fixing temperature range (FΔ).

Fixing ratio (%)=(Image density after separation/Image density before separation)×100

Test of Image Density

With an electrophotographic copying apparatus (DC-5585 manufactured by Mita Industrial Co., Ltd.) using (i) each of the electrophotographic developers above-mentioned as a start developer and (ii) the same toner as that contained in the start developer as a resupply toner, a solid-black document was continuously copied for 50,000 pieces. By extracting the first copied piece and every thousandth copied piece, total 51 copied pieces were extracted, as samples, from 50,000 copied pieces for each of the developers. With the reflection densitometer above-mentioned, the density of the copied image of each sample was measured. The developer with which there were obtained 50 or more samples, out of the total 51 samples, presenting an image density not less than 1.3, was evaluated as excellent (O), the developer with which there were obtained 40 to 49 samples presenting an image density not less than 1.3, was evaluated as good (Δ), and the developer with which there were obtained 39 or less samples presenting an image density not less than 1.3, was evaluated as bad (X).

Test of Image Fog

With the electrophotographic copying apparatus above-mentioned using (i) each of the electrophotographic developers above-mentioned as a start developer and (ii) the same toner as that contained in the start developer as a resupply toner, a black-white document was continuously copied for 50,000 pieces. By extracting the first copied piece and every thousandth copied piece, total 51 copied pieces were extracted, as samples, from 50,000 copied pieces for each of the developers. With the reflection densitometer above-mentioned, the density of the blank spaces of each sample was measured, and the number of samples of which image density was not greater than 0.003, was obtained. The developer with which there were obtained 50 or more samples presenting an image density not greater than 0.003, was evaluated as excellent (O), the developer with which there were obtained 40 to 49 samples presenting an image density not greater than 0.003, was evaluated as good (Δ), and the developer with which there were obtained 39 or less samples presenting an image density not greater than 0.003, was evaluated as bad (X).

Toner Scattering Test

For each of the developers, there were checked (i) the blank portion of the 50,000th copied piece taken in the fog density measurement, and (ii) the inside of the copying apparatus after 50,000 copies had been taken. The developer with which substantially no toner scattering was observed on the blank portion of the copied image and the inside of the copying apparatus, was evaluated as excellent (O), and the developer with which toner scattering was ovserved either inside of the copying apparatus or on the blank portion of the copied image, was evaluated as bad (X).

Observation of Blanking

For each of the developers above-mentioned, all 51 samples extracted in the fog density measurement above-mentioned were visually checked for presence of blanking. The developer with which there were obtained 50 or more samples presenting no blanking, was evaluated as excellent (O), the developer with which there were obtained 40 to 49 samples presenting no blanking, was evaluated as good (Δ), and the developer with which there were obtained 39 or less samples presenting no blanking, was evaluated as bad (X).

Measurement of Electric Charge

At the time of continuous 50,000-piece copying in the fog density measurement, each of the developers above-mentioned in the developing devices was sampled at the first copied piece and every 10,000th copied piece. The developers thus sampled were measured as to the electric charge ($-\mu C/g$) by a blow-off method.

Image-Quality Uniformity Test

With the same electrophotographic copying apparatus as that above-mentioned using (i) each of the electrophotographic developers above-mentioned as a start developer and (ii) the same toner as that contained in the start developer as a resupply toner, a 20 mm×20mm solid-black document was continuously copied for 50,000 pieces. By extracting the first copied piece and every thousandth copied piece, total 51 copied pieces were sampled. The image at the center portion of each reproduced image with the 2mm-wide peripheral edge thereof removed, was divided into 56 small sections. With a QTM display, there was measured the area ratio of the black (or white) portion of each small section. With the ratio value thus obtained, the average area ratio and the area ratio variation (standard deviation) were respectively calculated according to the following equations.

Average area ratio (%) =

Total area ratio (%)/Number of small sections (=56)

Area ratio standard deviation =

$$\sqrt{\frac{\Sigma\,(\text{Average area ratio} - \text{Individual section area ratio})^2}{\text{Number of small sections} - 1\ (=55)}}$$

On comparison Of the results of area ratio standard deviation with the results of organoleptic examination which was conducted by a plurality of persons, the coefficient of correlation r was 0.918. It was therefore turned out that both results approximately agreed with each other. Thus, image-quality uniformity was evaluated based on the results of area ratio standard deviation. The developer with which there were obtained 50 or more samples each containing an image presenting an area ratio standard deviation of not greater than 3, was evaluated as excellent (O), the developer with which there were obtained 40 to 49 samples each containing an image presenting an area ratio standard deviation of not greater than 3, was evaluated as good (Δ), and the developer with which there were obtained 39 or less samples each containing an image presenting an area ratio standard deviation of more than 3, was evaluated as bad (X).

TABLE 2

| | FΔ | Image Density | Image Fog | Toner Scattering | Blanking | Image Uniformity |
|---|---|---|---|---|---|---|
| Example 1 | 55 | ○ | ○ | ○ | ○ | ○ |
| Example 2 | 55 | ○ | ○ | ○ | ○ | ○ |
| Example 3 | 50 | ○ | ○ | ○ | ○ | ○ |
| Comparative Example 1 | 45 | ○ | ○ | ○ | ○ | X |
| Comparative Example 2 | 50 | ○ | Δ | Δ | ○ | Δ |
| Comparative Example 3 | 45 | Δ | X | X | Δ | X |
| Comparative Example 4 | 50 | ○ | Δ | ○ | ○ | Δ |
| Comparative Example 5 | 50 | Δ | X | X | Δ | Δ |
| Comparative Example 6 | 45 | Δ | X | ○ | Δ | Δ |
| Comparative Example 7 | 50 | X | X | X | X | X |

TABLE 3

| | Toner Electric Charge (−μC/g) | | | | | |
|---|---|---|---|---|---|---|
| | 1st piece | 10000th piece | 20000th piece | 30000th piece | 40000th piece | 50000th piece |
| Example 1 | 21.3 | 21.4 | 21.3 | 21.5 | 21.3 | 21.3 |
| Example 2 | 21.7 | 21.9 | 21.7 | 21.6 | 21.7 | 21.6 |
| Example 3 | 22.1 | 21.9 | 22.0 | 21.8 | 21.7 | 21.5 |
| Comparative Example 1 | 21.4 | 21.3 | 21.1 | 21.0 | 21.2 | 21.2 |
| Comparative Example 2 | 21.5 | 21.4 | 21.3 | 19.7 | 18.8 | 18.5 |
| Comparative Example 3 | 22.2 | 21.5 | 20.6 | 18.1 | 17.5 | 16.9 |

TABLE 3-continued

| | Toner Electric Charge (−μC/g) | | | | | |
|---|---|---|---|---|---|---|
| | 1st piece | 10000th piece | 20000th piece | 30000th piece | 40000th piece | 50000th piece |
| Comparative Example 4 | 21.8 | 21.6 | 21.3 | 18.9 | 19.1 | 18.2 |
| Comparative Example 5 | 20.9 | 21.0 | 18.6 | 17.4 | 17.1 | 16.5 |
| Comparative Example 6 | 22.2 | 21.5 | 20.6 | 18.1 | 17.5 | 16.9 |
| Comparative Example 7 | 21.0 | 19.7 | 18.5 | 16.3 | 16.1 | 15.5 |

From the results of Tables 2 and 3, it was found that, with the developer of Comparative Example 1 using the toner (7) containing the fixing resin of which detection-ending molecular weight $M_E$ exceeded 2000, the image quality uniformity was bad and the fixing temperature range FΔ was narrow so that the paper-fixing properties of this developer were bad.

It was also found that, with the developer of Comparative Example 5 using the toner (4) containing the fixing resin of which detection-ending molecular weight $M_E$ was less than 300, toner agglomerates were produced to provoke blanking and the image quality uniformity was deteriorated. It was further found that the developer of Comparative Example 5 was lowered in the amount of electric charge on and after about the 20,000th copied piece in the continuous copying operation, thereby to provoke fog, toner scattering and decrease in image density.

It was also found that, with the developer of Comparative Example 7 jointly using the toner (4) and the carrier (c) coated with the coating resin containing no 2-hydroxyethyl acrylate, the test results were worse than those of Comparative Example 5 and the amount of electric charge was lowered on and after around the 10,000th copied piece in the continuous copying operation.

It was also found that the developer of Comparative Example 2 using the toner (3) containing the fixing resin of which detection-starting molecular weight $M_S$ exceeded $2\times10^8$, was lowered in the amount of electric charge on and after about the 30,000th copied piece in the continuous copying operation, thereby to provoke fog and toner scattering. It was further found that, with the developer of Comparative Example 2, the image quality uniformity was deteriorated.

It was also found that, with the developer of Comparative Example 3 jointly using the toner (3) and the carrier (c) coated with the coating resin containing no 2-hydroxyethyl acrylate, the test results were worse than those of Comparative Example 2 and the fixing temperature range FΔ was narrow to deteriorate the paper-fixing properties.

It was also found that, with the developer of Comparative Example 6 jointly using the toner (6) containing the fixing resin of which detection-starting molecular weight $M_S$ was below $1.6\times10^7$ and the carrier (c), the fixing temperature range FΔ was particularly narrow so that the paper-fixing properties were bad. It was further found that the developer of Comparative Example 6 was lowered in the amount of electric charge on and after about 30,000th piece in the continuous copying operation, thereby to provoke fog.

It was also found that the developer of Comparative Example 4 jointly using the toner (2) containing the fixing resin of which molecular-weight distribution was in the range determined in the present invention and the carrier (c), was lowered in the amount of electric charge on and after the 30,000th piece in the continuous copying operation, thereby to provoke fog.

On the other hand, it was found that each of the developers of Examples 1 to 3 in accordance with the present invention was excellent in the characteristics above-mentioned and presented no decrease in the amount of electric charge throughout the 50,000-piece continuous copying operation so that, even though repeatedly agitated in the developing device, these developers were not deteriorated and assured good durability and long life-time.

We claim:

1. An electrophotographic developer comprising (i) a toner containing, as a fixing resin, a styrene-acrylic copolymer presenting a gel permeation chromatogram showing a molecular-weight distribution in which the detection-starting molecular weight is located in a range from $1.6\times10^7$ to $2\times10^8$ and the detection-ending molecular weight is located in a range from 300 to 2,000, and (ii) a carrier coated with a coating resin which is a styrene-acrylic copolymer containing 0.1 to 2% by weight 2-hydroxyethyl acrylate.

2. An electrophotographic developer according to claim 1, wherein the styrene-acrylic copolymer serving as the toner fixing resin presents a gel permeation chromatogram showing a molecular-weight distribution in which two maximum values are respectively located in a range of not less than $1\times10^5$ and a range from 500 to $2\times10^4$ and the minimum value is located between said both maximum values, and in which the ratio of the area of the valley part containing said minimum value and located below a common tangential line which connects both peaks to the total peak area containing said both maximum values, is not greater than 0.30.

3. An electrophotographic developer according to claim 1, wherein the styrene-acrylic copolymer serving as the toner fixing resin is a styrene/methyl methacrylate/butyl acrylate copolymer containing 75 to 85% by weight of styrene, 0.5 to 5% by weight of methyl methacrylate, and 10 to 20% by weight of butyl acrylate.

* * * * *